US007661275B2

(12) United States Patent
Broadbent et al.

(10) Patent No.: US 7,661,275 B2
(45) Date of Patent: Feb. 16, 2010

(54) ICE MAKING METHOD AND MACHINE WITH PETD HARVEST

(75) Inventors: John A. Broadbent, Centennial, CO (US); William E. Smith, Land O'Lakes, FL (US)

(73) Assignee: Mile High Equipment L.L.C., Denver, CO (US)

( * ) Notice: Subject to any disclaimer, the term of this patent is extended or adjusted under 35 U.S.C. 154(b) by 298 days.

(21) Appl. No.: 11/485,827

(22) Filed: Jul. 13, 2006

(65) Prior Publication Data

US 2007/0079627 A1 Apr. 12, 2007

Related U.S. Application Data

(60) Provisional application No. 60/724,221, filed on Oct. 6, 2005, provisional application No. 60/724,253, filed on Oct. 6, 2005.

(51) Int. Cl.
*F25C 5/08* (2006.01)

(52) U.S. Cl. ..... 62/351; 62/277

(58) Field of Classification Search ..... 62/137, 62/157, 253, 347, 233, 277; 219/482, 202
See application file for complete search history.

(56) References Cited

U.S. PATENT DOCUMENTS

| | | | | |
|---|---|---|---|---|
| 2,069,567 | A * | 2/1937 | White | 62/350 |
| 2,112,263 | A * | 3/1938 | Bohannon et al. | 62/350 |
| 3,803,862 | A | 4/1974 | Shumacher | 62/137 |
| 4,006,605 | A | 2/1977 | Dickson et al. | 62/356 |
| 4,505,130 | A | 3/1985 | Hibino et al. | 62/347 |
| 5,582,754 | A * | 12/1996 | Smith et al. | 219/438 |
| 6,870,139 | B2 | 3/2005 | Petrenko | 219/482 |
| 7,059,140 | B2 * | 6/2006 | Zevlakis | 62/66 |
| 7,444,829 | B2 | 11/2008 | Mori et al. | 62/351 |
| 2004/0149734 | A1 | 8/2004 | Petrenko et al. | 219/538 |
| 2005/0035110 | A1 | 2/2005 | Petrenko | 219/482 |

* cited by examiner

*Primary Examiner*—Melvin Jones
(74) *Attorney, Agent, or Firm*—Ohlandt, Greeley, Ruggiero & Perle, L.L.P

(57) ABSTRACT

An ice making has an ice making mold with a plurality of ice making cells opened at the bottom, a water tank, water spray nozzles adapted for spraying the water contained in the water tank towards the ice making cells, an ice bin adapted for storage of ice cubes formed in and harvested from the ice making cells, and an inclined plate having water spray openings and recovery openings and mounted between the ice making mold and the water spray nozzles. The ice making cells are each attached to a serpentine evaporator tube, which is cooled by a refrigeration system and also heated by way of electrical pulse energy. The electrical pulse heating of the ice making cells allows ice to be quickly and efficiently harvested from the cells.

16 Claims, 4 Drawing Sheets

ICE MAKING METHOD AND MACHINE WITH PETD HARVEST

RELATED APPLICATION

This application claims the benefit of U.S. Provisional Patent Application Ser. No. 60/724,221, filed Oct. 6, 2005, the entire contents of which are hereby incorporated by reference, and U.S. Provisional Patent Application Ser. No. 60/724,253, filed Oct. 6, 2005, the entire contents of which are hereby incorporated by reference.

FIELD OF THE INVENTION

The present invention relates to an ice making machine and, more particularly, to an ice making machine that harvests ice with electrical energy.

BACKGROUND OF THE INVENTION

A known ice making machine having a plurality of ice-making cells each of which is opened at the bottom and closed at the top is described in U.S. Pat. No. 4,505,130. This ice machine is shown, by way of example, in FIG. 1 and comprises an ice making mold 1, a water tank 11 disposed therebelow, an ice bin 12 disposed close to water tank 11, and an inclined plate 7 positioned intermediate ice making mold 1 and water tank 11 and having a downward gradient towards ice bin 12. Ice making mold 1 has a soup plate-like member 5 having a large number of through-holes with ice making cups 2 engaged in inverted position in the through-holes. Ice making cups 2 define ice making cells closed at the top and opened at the bottom. An evaporator 3 in the form of a heat exchange tube is disposed in heat exchange relation with ice making cups 2. Inclined plate 7 has water spray openings 8 to permit water to be sprayed into the ice making cells 4 from a plurality of spray nozzles 10*a* of a water spray tube 10 mounted below inclined plate 7 (only one spray nozzle 10*a* being shown in the drawing). Plate 7 also has water recovery openings 9 to permit recovery into water tank 11 of return water that has been sprayed into the ice making cells but descended unfrozen onto inclined plate 7. Water is supplied to water spray tube 10 by a water circulating pump 11*a* associated with water tank 11.

In such ice making machine, prior to starting an ice making cycle of operation, a water valve WV provided to a water supply tube 6 is opened for supplying water to a cavity 5*b* of soup plate-like member 5. The water thus supplied descends onto inclined plate 7 through an opening 5*a* in the bottom of soup plate-like member 5 to descend further therefrom into water tank 11 through recovery openings 9 of inclined plate 7. When the water in water tank 11 has attained a predetermined level, water valve WV is closed for driving water circulating pump 11*a* and a refrigerating system including evaporator 3 into operation. This initiates the ice making operation so that ice making cups 2 are cooled by evaporator 3, while the ice making water is sprayed from spray nozzles 10*a* into the thus cooled ice making cups 2. Thus, an ice cube is grown gradually in each ice making cell 4. The unfrozen water descends onto inclined plate 7 as mentioned hereinabove.

When the ice cube has grown to a predetermined size, such state is sensed by a known ice making sensor, which then causes cessation of the ice making operation and start of the ice harvesting operation. In such ice harvesting operation, water valve WV is again opened to supply water to cavity 5*b* of soup plate-like member 5, while simultaneously a hot gas valve, not shown, of the refrigerating system is opened for supplying a hot gas into evaporator 3. The result is that ice cubes formed in the ice making cells 4 are heated and melted free from ice making cups 2 and descend onto inclined plate 7 to slide down thereon to be stocked in ice bin 12.

This prior art method of harvesting the ice represents a loss in ice making efficiency due to: (a.) the amount of ice that is melted during the harvesting operation caused by the excess heat provided by both the hot gas in evaporator 3 and the warm water introduced onto soup plate-like member 5, (b) the time it takes to perform the harvest operation—such time not being available to make ice, and (c) the excess heating of evaporator 3—such heat having to be removed from evaporator 3 during the subsequent ice making cycle.

Hence, there is a strong demand for an ice making machine which avoids the aforementioned deficiency and provides an ice making machine whereby the ice formed in ice making cells can be removed quickly and efficiently minimizing excess meltage of the ice, removing the ice more quickly than is possible with a hot gas defrost, and avoiding any excess heating of evaporator or ice making cells.

SUMMARY OF THE INVENTION

The ice making machine of the present invention comprises a water supply, a refrigerant supply, an electrical energy source, a controller and an evaporator assembly that comprises an array of ice forming surfaces. During a freeze mode, the controller operates the water supply and the refrigerant supply to form ice on the ice forming surfaces. During a harvest mode, the controller operates the electrical energy source to apply electrical pulse energy to the evaporator assembly to melt an interfacial layer of the ice such that it is freed from the surfaces.

In one embodiment of the ice making machine of the present invention, the evaporator assembly comprises an ice mold that comprises at least one of the ice forming surfaces. The electrical pulse energy is applied to a member of the group consisting of: the ice mold and an electrically conductive element that is in thermal transfer relation to the ice mold.

In another embodiment of the ice making machine of the present invention, the evaporator assembly further comprises an evaporator tube and the electrically conductive element comprises the evaporator tube.

In another embodiment of the ice making machine of the present invention, the electrical energy source is connected in circuit with a segment of the evaporator tube.

In another embodiment of the ice making machine of the present invention, the segment is between a midpoint and an end point of the evaporator tube.

In another embodiment of the ice making machine of the present invention, the electrical energy source is further connected in circuit with the midpoint and an opposite end point of the evaporator tube.

In another embodiment of the ice making machine of the present invention, the end points are connected to a circuit reference.

In another embodiment of the ice making machine of the present invention, the electrically conductive element comprises an electrically conductive ice mold.

In another embodiment of the ice making machine of the present invention, the ice mold is selected from the group consisting of: cups and fingers.

A method of the present invention makes ice with an ice making machine that comprises an evaporator assembly comprising an array of ice forming surfaces, a water supply, a refrigerant supply and an electrical energy source. The method comprises in a freeze mode operating the water supply and the refrigerant supply to form ice on the ice forming surfaces and in a harvest mode operating the electrical energy source to apply electrical pulse energy to the evaporator assembly to melt an interfacial layer of the ice such that it is freed from the surfaces.

In one embodiment of the method of the present invention, the evaporator assembly comprises an ice mold that comprises at least one of the ice forming surfaces. The electrical pulse energy is applied to a member of the group consisting of: the ice mold and an electrically conductive element that is in thermal transfer relation to the ice mold.

In another embodiment of method of the present invention, the evaporator assembly further comprises an evaporator tube, and wherein the electrically conductive element comprises the evaporator tube.

In another embodiment of the method of the present invention, the electrically conductive element comprises an electrically conductive ice mold.

In another embodiment of the method of the present invention, the ice mold is selected from the group consisting of: cups and fingers.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

The ice making machine in one embodiment of the present invention comprises an ice making mold comprising a plurality of inverted ice making cups each defining an ice making cell closed at the top and opened at the bottom, a water tank disposed below said ice making mold, an ice bin disposed adjacent to said water tank, and an inclined plate mounted between said ice making mold and said water tank with a downward gradient towards said ice bin. The inclined plate has a plurality of water spray openings through which water contained in the water tank can be sprayed towards ice making cells by a water circulating pump through a plurality of spray nozzles positioned on the lower side of the inclined plate. The inclined plate also has a plurality of recovery openings through which water falling on the inclined plate is recovered and restored to the water tank.

According to one embodiment of the present invention, the prior art configuration of the evaporator is modified to include conductors used to conduct low voltage, high current electrical power to a serpentine copper tube of the evaporator 3. Electrical power is applied to the serpentine copper evaporator tube in a pulse that causes immediate resistance heating of the tube and the ice making cells which are attached to it. This rapid heating of the evaporator and the ice making cells via an electrical pulse causes the ice cubes in the ice making cells to be rapidly melted free from the cells without need for a hot gas defrost or the addition of water to soup plate-like member 5. This rapid melting improves the ice making efficiency of the ice machine by minimizing the amount of ice that is melted during defrost, minimizing the time required (thus allowing more time to make—instead of melt—more ice), and keeping the temperature of the evaporator cups relatively low so that less energy is required to subsequently cool the evaporator.

Figure 1:
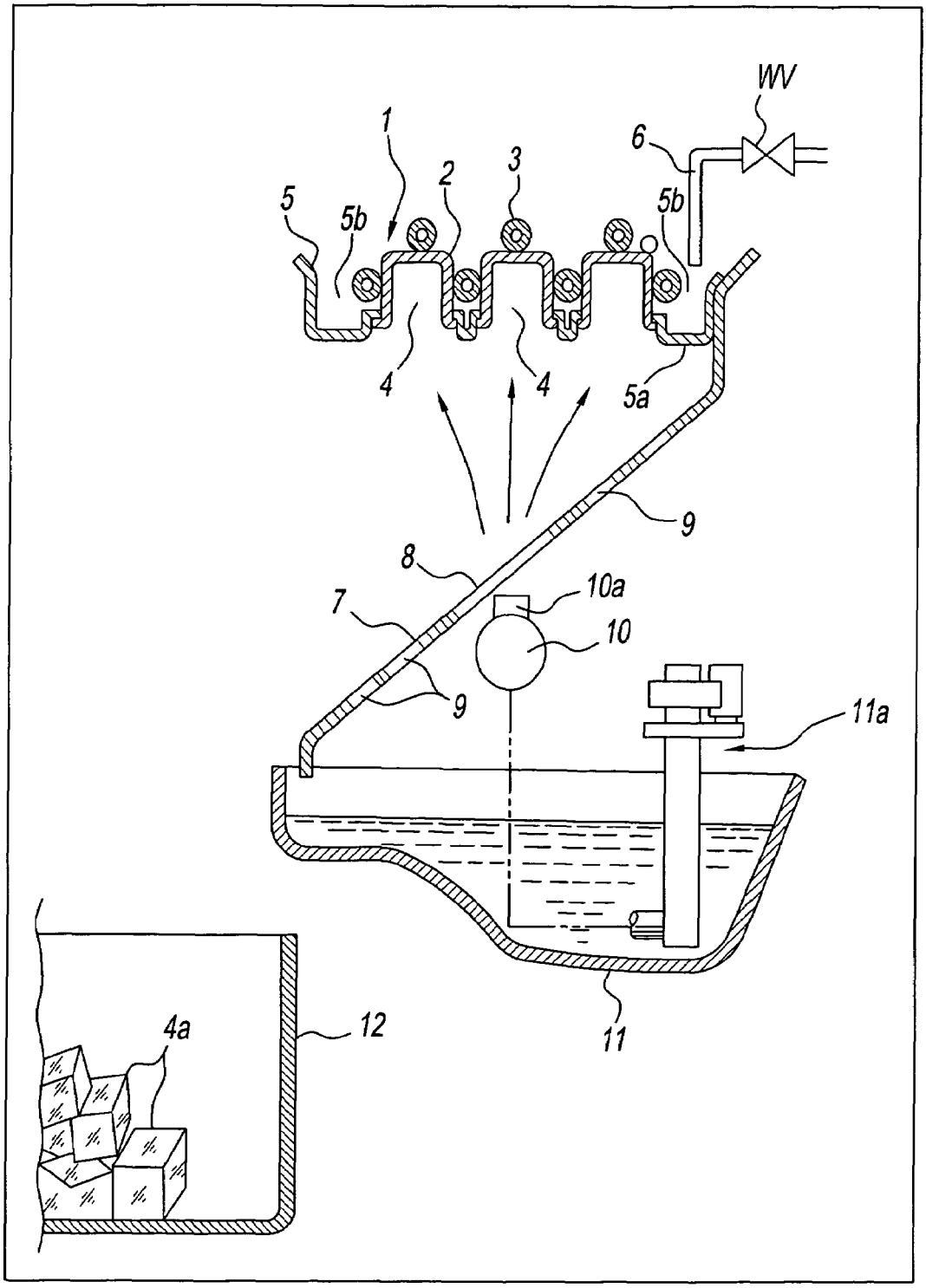
Fig. 1 (Prior Art)
FIG. 1 is a diagrammatic sectional view showing substantial parts of the conventional prior art open-cell type ice making machine.
Figure 2:
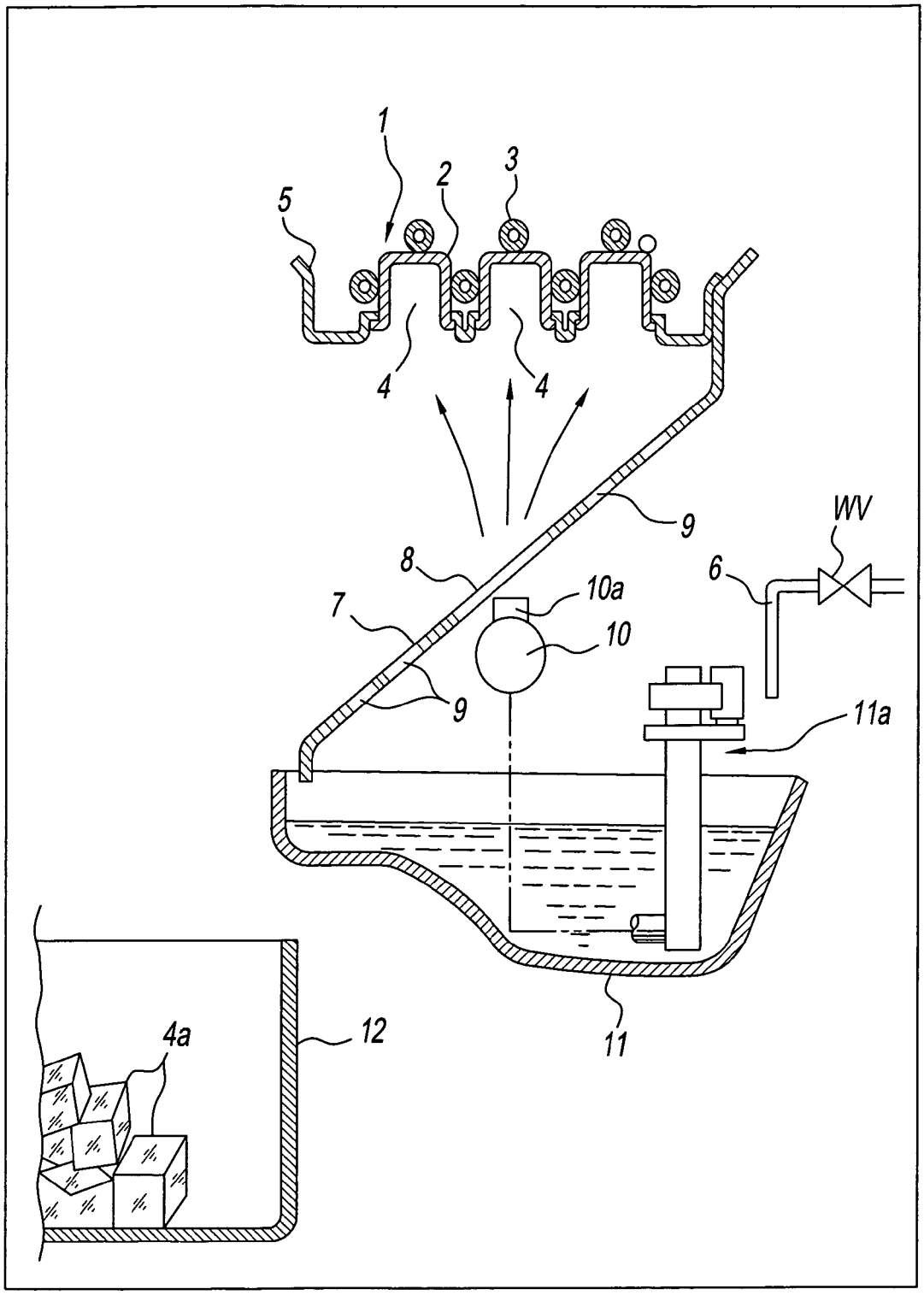
FIG. 2 is a diagrammatic sectional view showing substantial parts of the open cell type ice making machine according to the present invention.
Figure 3:
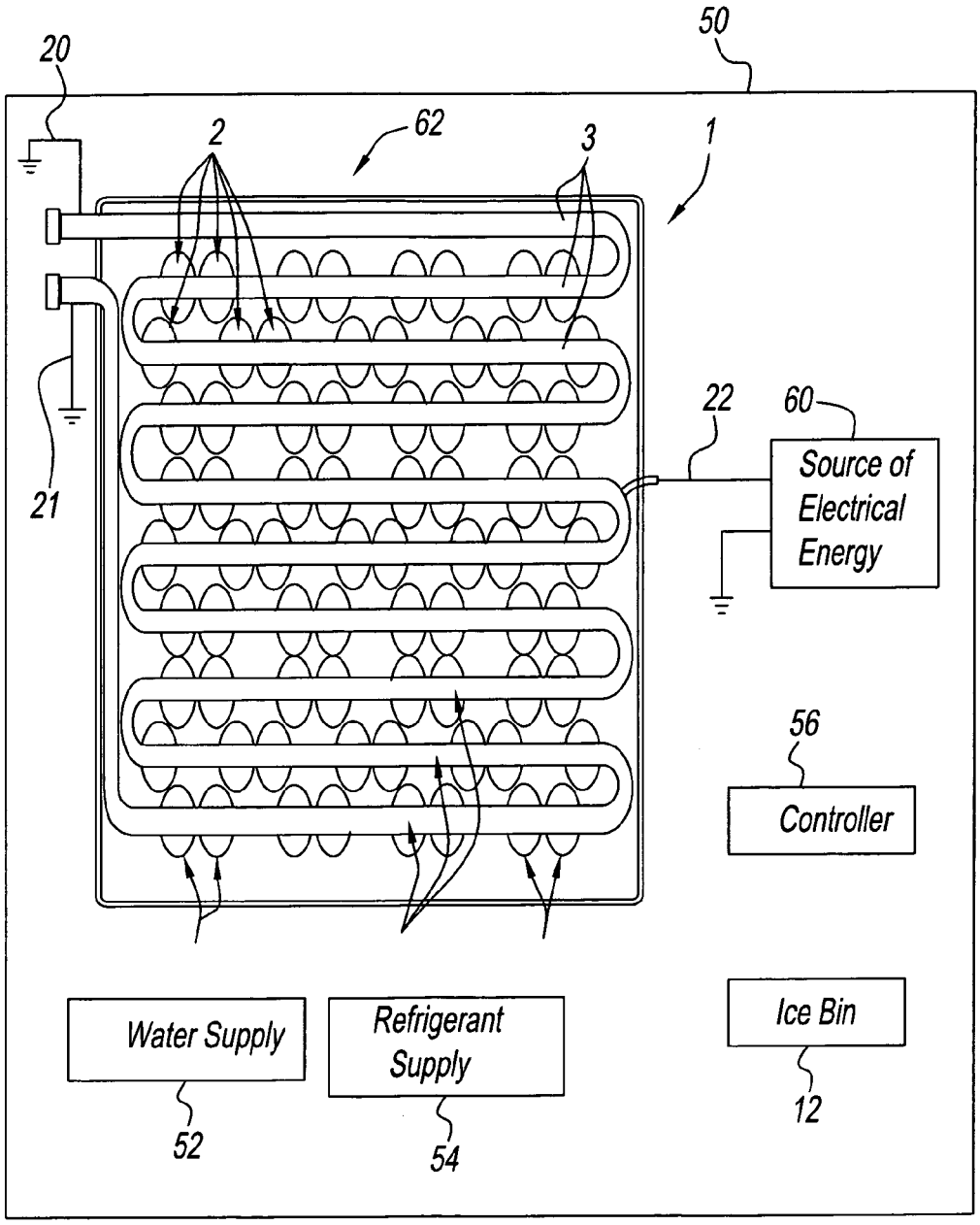
FIG. 3 is a diagrammatic view showing the top of the evaporator assembly as shown in FIG. 2.

Referring to FIGS. 2 and 3, an embodiment of an ice making machine 50 of the present invention is somewhat similar to the ice making machine of FIG. 1 and parts that correspond to parts of the ice making machine of FIG. 1 bear the same reference numerals. One difference is that the water valve WV and water supply tube 6 are located directly above water tank 11 as shown in FIG. 2. Ice making machine 50 comprises evaporator assembly 62, a water supply 52, a refrigerant supply 54, a controller 56 and a source 60 of electrical energy. Evaporator assembly 62 comprises ice mold 1 and evaporator tube 3. Evaporator tube 3 is interconnected with refrigerant supply 54. The water valve WV is interconnected with water supply 52. Controller 56 controls the freezing and harvesting cycles by appropriately controlling electrical energy, the flow of water and refrigerant to evaporator assembly 62.

Referring to FIG. 3, electrical energy source 60 is connected in circuit with evaporator tube 3, which is constructed of electrically conductive material. For example, evaporator tube may be made of metal, such as copper, aluminum or steel. Electrical energy source 60 is connected via an electrical connector 20 to a midpoint of evaporator tube 3 (electrically equidistant from the ends of evaporator tube 3) and via an electrical connector 24 to a circuit reference, e.g., circuit ground. The ends of evaporator tube 3 are also connected to circuit ground via electrical connectors 20 and 21. By grounding the ends of evaporator tube 3 with conductors 20 and 21, electrical current is prevented from leaking into refrigeration supply 54.

In accordance with the present invention, electrical energy source 60 is operable at the time of harvest to apply one or more pulses of electric energy to evaporator tube 3 to melt an interfacial layer of the ice at the interface of the ice and evaporator tube 3 sufficiently to loosen the ice so that it falls into ice bin 12.

Electrical energy source 60 and the pulsed energy used for thermal de-icing, for example, may be of the type described in U.S. Pat. No. 6,870,139, U.S. Patent Publication No. 2005/0035110, and U.S. Patent Publication No. 2004/0149734, all of which are incorporated herein in their entirety by reference thereto, that is capable of supplying pulsed energy. Modulating the pulsed energy to the interface of the ice to ice mold 1 and/or evaporator tube 3 modifies a coefficient of friction between the ice and ice mold 1 and/or evaporator tube 3. The electrical pulse energy technology is known as Pulse Electro Thermal De-icing (PETD).

Typically, a pulse de-icer system heats an interface to a surface of an object so as to disrupt adhesion of ice with the surface. To reduce the energy requirement, one embodiment of a pulse de-icer explores a very low speed of heat propagation in non-metallic solid materials, including ice, and applies heating power to the interface for time sufficiently short for the heat to escape far from the interface zone; accordingly, most of the heat is used to heat and melt only a very thin layer of ice (hereinafter "interfacial ice"). The system preferably includes a power supply configured to generate a magnitude of power. In one aspect, the magnitude of the power has a substantially inverse-proportional relationship to a magnitude of energy used to melt ice at the interface. The pulse de-icer system may also include a controller configured to limit a duration in which the power supply generates the magnitude of the power. In one aspect, the duration has a substantially inverse-proportional relationship to a square of the magnitude of the power. The power supply may further include a switching power supply capable of pulsing voltage. The pulsed voltage may be supplied by a storage device, such as a battery or a capacitor. The battery or capacitor can, thus, be used to supply power to a heating element that is in thermal communication with the interface.

A preferred pulse de-icer systems is hereafter described. This pulse de-icer system may be used to remove ice from a surface of an object such as a ice forming cup or finger, typically by melting an interfacial layer of ice and/or modifying a coefficient of friction of an object-to-ice interface.

One such pulse de-icer system for modifying an interface between an evaporator assembly and ice according to the present disclosure comprises: a power supply, a controller, and a heating element. In one embodiment, the power supply is configured for generating power with a magnitude that is substantially inversely proportional to a magnitude of energy used to melt interfacial ice (hereinafter "interfacial ice") at the interface. A heating element is coupled to the power supply to convert the power into heat at the interface. Controller is coupled to the power supply to limit a duration in which the heating element converts the power into heat. In one embodiment, the duration in which the heating element converts the power into heat at the interface is substantially inversely proportional to a square of the magnitude of the power.

Controller 56 controls electrical energy source 60 to apply electrical pulse energy when the ice in ice making cells 4 has grown to the desired predetermined size. The electrical pulse energy causes electrical resistance heating of evaporator tube 3 and heating of ice making cups 2 by thermal conduction from evaporator tube 3 to cups 2. The fast, even heating of cups 2 releases the ice in cells 4 more quickly than with the prior art defrost methods, minimizes the amount of melting that occurs, and releases the ice without heating cups 2 to as warm of a temperature.

The electrical pulse flows in an electrical circuit comprising evaporator tube 3, conductors 20, 21 and 22. This electrical pulse, which flows through the full length of serpentine evaporator tube 3, causes electrical heating of evaporator tube 3. The heating of evaporator tube 3 will in turn, via thermal conduction, causes rapid heating of ice making cups 2, thereby releasing the ice in cells 4.

Referring to FIGS. 2 and 3, controller 56 controls water valve WV to be first opened in order to allow ice making water to be filled to a predetermined level in water tank 11. When water has been filled to a predetermined level in water tank 11, controller 56 closes water valve WV for starting the ice making operation. During the ice making operation, controller 56 controls refrigerant supply 54 to supply refrigerant to evaporator tube 3 for cooling ice making cups 2. Controller 56 operates water circulating pump 11*a* to supply water contained in water tank 11 to spray nozzles 10*a* of water spray tube 10. Thus, a part of sprayed water is frozen and affixed to the inner surface of each ice making cup 2 for forming an ice layer, which then grows in size gradually to an ice cube. The water that has not become frozen into ice descends from ice making cups 2 onto inclined plate 7 and then flows through water recovery openings 9 into water tank 11.

When the ice cubes in ice making cups 2 have reached the predetermined size and thus it is time to harvest the ice, such state is sensed by means well known in the art and controller 56 switches ice making machine 50 from an ice making operation, mode or cycle to an ice harvesting operation, mode or cycle.

In the ice harvesting operation, controller 56 stops the operation of water circulating pump 11*a* so as to stop water spraying from water spray nozzles 10*a*. Controller 56 then controls electrical pulse source 60 to apply an electrical pulse through conductors 20, 21 and 22 to evaporator tube 3. This causes electrical resistance heating of evaporator tube 3 and, by way of thermal conduction, heats ice making cups 2. The result is that ice making cups 2 are warmed by the electrical pulse. By such warming, the ice cubes in respective ice making cells 4 are melted so that the cubes are detached by gravity from ice making cups 2 and fall onto inclined plate 7. It should be noted that not only water spray openings 8 but also water recovery openings 9 in inclined plate 7 are sufficiently smaller than the ice cubes and, hence, are not obstructive to the ice cubes sliding down on inclined plate 7 into ice bin 12.

From the foregoing it may be seen that the arrangement of the present invention provides an automatic ice making machine in which harvesting of the ice is achieved very quickly and in a very energy-efficient manner.

Figure 4:
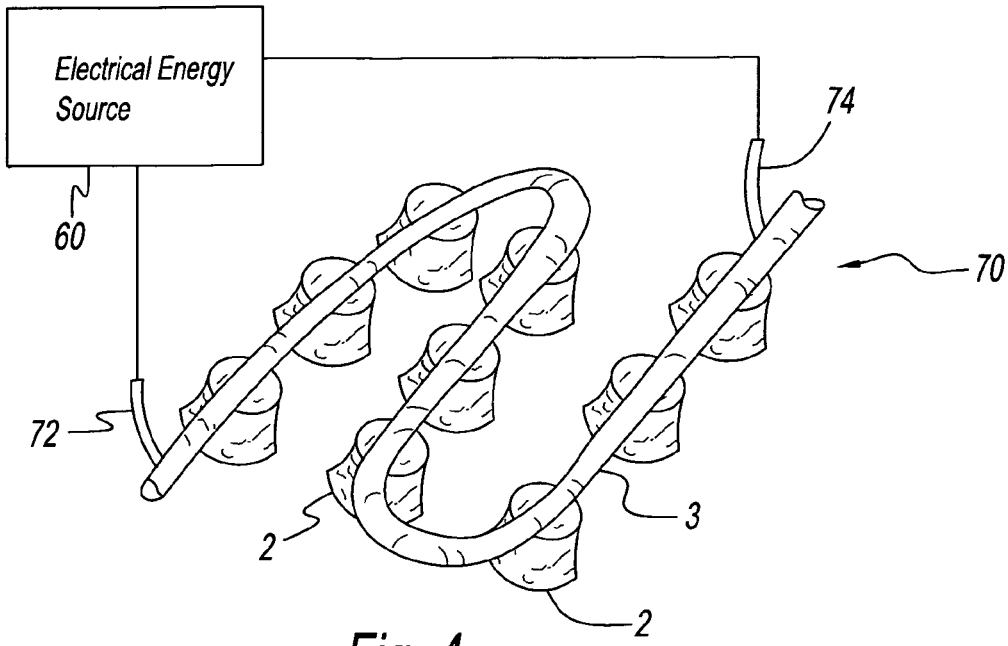
FIG. 4 is a perspective view of another embodiment of the evaporator assembly.

Referring to FIG. 4, an alternate embodiment of the ice making machine of the present invention comprises an evaporator assembly 70 comprised of evaporator tube 3 and ice forming cups 2. Electrical energy source 60 is connected to evaporator tube 3 at spaced points thereof via electrical connectors 72 and 74. The spaced points could be any points along the length including the ends thereof. Cups 2 are shaped to provide shot glass shaped cubes. Vent holes 76 are provided in cups 2 to break the vacuum as the ice cubes fall during harvest.

Figure 5:
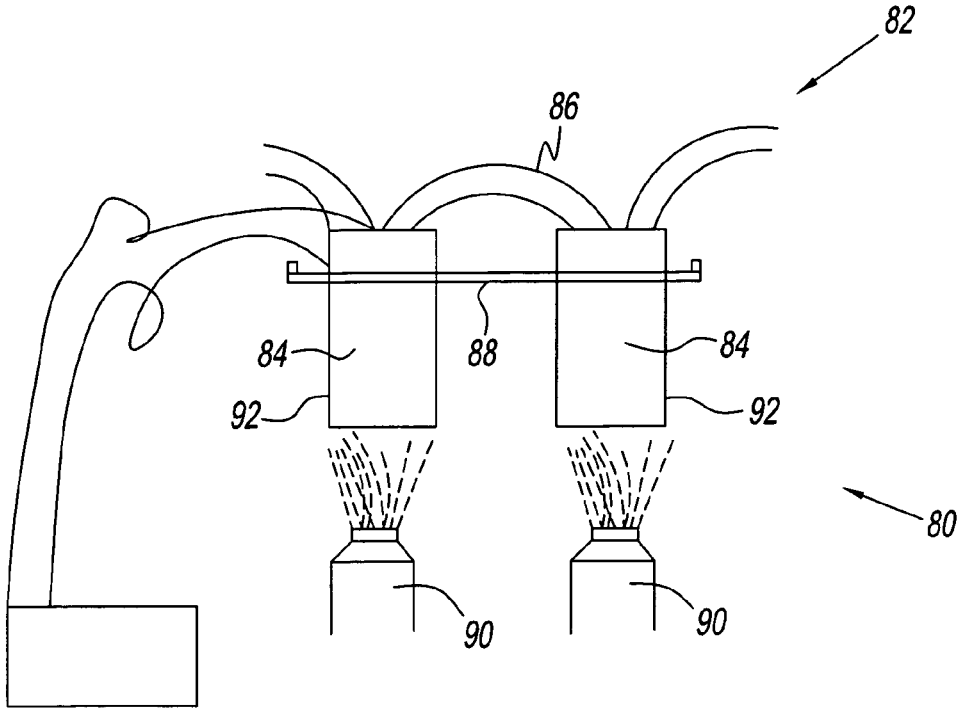
FIG. 5 is a diagram another embodiment of an ice making machine of the present invention.

Referring to FIG. 5, another embodiment of the present invention comprises an ice making machine 80. Ice making machine 80 is similar to ice making machine 50 in that it comprises electrical energy source 60, an evaporator assembly 82, a controller (not shown), a water supply (not shown), a refrigerant supply (not shown), and an ice bin (not shown).

Evaporator assembly 82 comprises a plurality of ice making fingers 84 and an evaporator tube 86 that is disposed in contact with fingers 84. Fingers 84 are held in an array by a support 88. As known in the art, in a finger style machine ice is formed by spraying water with spray nozzles 90 on fingers 84. Alternatively, fingers 84 could be dipped into a water sump (not shown) to form ice thereon during the freeze mode.

One or more conductive strips 92 is formed on each finger 84. Electrical energy source 60 is connected to conductive strips 92. The controller (not shown) controls electrical energy source 60 to apply pulse energy to conductive strips 92 to melt an interfacial layer of the ice at the interface of the ice and conductors 84 to sufficiently to loosen the ice so that it falls into the ice bin (not shown). In an alternate embodiment, the electrical energy can be applied to the conductive fingers and the conductive strips can remain or be omitted depending on how much electrical resistance is needed in a particular design to produce the desired interfacial ice melt.

Although the ice molds described in the foregoing embodiments comprise cups and fingers, it will be appreciated by those skilled in the art that ice molds for other ice shapes can be also be used.

The present invention having been thus described with particular reference to the preferred forms thereof, it will be obvious that various changes and modifications may be made therein without departing from the spirit and scope of the present invention as defined in the appended claims.

What is claimed is:

1. An ice making machine comprising:

an evaporator assembly comprising an array of ice forming surfaces;

a water supply, a refrigerant supply and an electrical energy source; and a controller that during a freeze mode operates said water supply and said refrigerant supply to form ice on said ice forming surfaces and during a harvest mode operates said electrical energy source to apply electrical pulse energy to said evaporator assembly to melt an interfacial layer of said ice such that it is freed from said surfaces, wherein said electrical pulse energy produces a pulsed current flow in said evaporator assembly and heat that melts said interfacial layer.

2. The ice making machine of claim 1, wherein said evaporator assembly comprises an ice mold that comprises at least one of said ice forming surfaces, and wherein said electrical pulse energy is applied to a member of the group consisting of:

said ice mold and an electrically conductive element that is in thermal transfer relation to said ice mold.

3. The ice making machine of claim 2, wherein said evaporator assembly further comprises an evaporator tube, and wherein said electrically conductive element comprises said evaporator tube.

4. The ice making machine of claim 3, wherein said electrical energy source is connected in circuit with a segment of said evaporator tube.

5. The ice making machine of claim 4, wherein said segment is between a midpoint and an end point of said evaporator tube.

6. The ice making machine of claim 5, wherein said electrical energy source is further connected in circuit with said midpoint and an opposite end point of said evaporator tube.

7. The ice making machine of claim 6, wherein said end points are connected to a circuit reference.

8. The ice making machine of claim 2, wherein said electrically conductive element comprises an electrically conductive ice mold.

9. The ice making machine of claim 2, wherein said ice mold is selected from the group consisting of: cups and fingers.

10. A method of making ice with an ice making machine that comprises an evaporator assembly comprising an array of ice forming surfaces, a water supply, a refrigerant supply and an electrical energy source, said method comprising:

during a freeze mode operating said water supply and said refrigerant supply to form ice on said ice forming surfaces; and during a harvest mode operating said electrical energy source to apply electrical pulse energy to said evaporator assembly to melt an interfacial layer of said ice such that it is freed from said surfaces, wherein said electrical pulse energy produces a pulsed current flow in said evaporator assembly and heat that melts said interfacial layer.

11. The method of claim 10, wherein said evaporator assembly comprises a ice mold that comprises at least one of said ice forming surfaces, and wherein said electrical pulse energy is applied to a member of the group consisting of: said ice mold and an electrically conductive element that is in thermal transfer relation to said ice mold.

12. The method of claim 11, wherein said evaporator assembly further comprises an evaporator tube, and wherein said electrically conductive element comprises said evaporator tube.

13. The method of claim 11, wherein said electrically conductive element comprises an electrically conductive ice mold.

14. The method of claim 11, wherein said ice mold is selected from the group consisting of: cups and fingers.

15. The ice making machine of claim 1, wherein said electrical pulse energy is Pulse Electro Thermal Deicing (PETD) energy.

16. The ice making machine of claim 10, wherein said electrical pulse energy is Pulse Electro Thermal Deicing (PETD) energy.

* * * * *